US012467706B2

(12) United States Patent
Pushkarev

(10) Patent No.: US 12,467,706 B2
(45) Date of Patent: Nov. 11, 2025

(54) TRIGGER MECHANISM FOR FIREARMS

(71) Applicant: Nikolai Pushkarev, Irkutsk (RU)

(72) Inventor: Nikolai Pushkarev, Irkutsk (RU)

( * ) Notice: Subject to any disclaimer, the term of this patent is extended or adjusted under 35 U.S.C. 154(b) by 0 days.

(21) Appl. No.: 18/765,631

(22) Filed: Jul. 8, 2024

(65) Prior Publication Data

US 2025/0180316 A1 Jun. 5, 2025

(51) Int. Cl.
*F41A 19/10* (2006.01)
*F41A 19/12* (2006.01)
*F41A 19/14* (2006.01)

(52) U.S. Cl.
CPC ..... *F41A 19/10* (2013.01); *F41A 19/12* (2013.01); *F41A 19/14* (2013.01)

(58) Field of Classification Search
CPC ..... F41A 19/14; F41A 19/10; F41A 19/12
USPC ..... 42/69.01, 69.03
See application file for complete search history.

(56) References Cited

U.S. PATENT DOCUMENTS 7,181,880 B2 * 2/2007 Keeney ..... F41A 19/44 42/69.03
8,505,225 B1 * 8/2013 Degener ..... F41A 19/10 42/69.01

* cited by examiner

*Primary Examiner* — Reginald S Tillman, Jr.
(74) *Attorney, Agent, or Firm* — Nadya Reingand

(57) ABSTRACT

The invention is aimed at improving the accuracy of shooting by reducing the force on a trigger of a firearm during firing. The technical result is achieved by the fact that the design of the trigger mechanism includes a housing in which a hammer and a hammer spring are installed, a tubular axle on which the trigger having a groove allowing longitudinal movement along the axle is installed, thereby disengaging a return mechanism installed in its housing, a roller sear, and a single-fire sear. To engage the return mechanism, the trigger and the hammer are equipped with cams, and when a breechblock carrier is recoiled, the hammer is lowered and its cam affects the trigger cam, forcing the trigger to move backwards (if it has been moved to a forward position before). The return mechanism is also engaged when a safety lock is activated.

2 Claims, 6 Drawing Sheets

TRIGGER MECHANISM FOR FIREARMS

CROSS-REFERENCES

This patent application claims priority to Russian patent application RU20231311478 filed Dec. 1, 2023, currently issued as a patent No. 224607.

TECHNICAL FIELD

The invention relates to firearms, namely, to hammer-type trigger mechanisms.

BACKGROUND OF THE INVENTION

RU 2372574 discloses a roller sear-hammer interface for a firearm. The sear has a roller rotatably mounted between two side plates forming a portion of the sear body. As a trigger is moved, a linkage connecting the trigger and the sear causes the sear to pivot rearward such that the roller engages a notched surface formed in the hammer. This rolling action releases the hammer to strike a firing pin to fire a round of ammunition. When the trigger is released, the sear roller rolls downward into an engaged and locked position within the notch formed in the hammer.

Thereafter, as the hammer is moved back to its cocked, ready-to-fire position, upon release of the trigger, the sear roller again will be engaged by and roll downwardly into a fully engaged and locked position within the notch of the hammer.

By default, the hammer is acted upon by a spring; otherwise, it is not possible to engage the roller sear and the hammer, because the roller sear will remain in the position where the hammer will come off the sear, and thus there will be no engagement of the sear with the hammer after the cycle of operation of a breechblock or a breechblock carrier.

Therefore, in order for the roller sear-hammer interface to open, it is necessary to overcome the resistance of the trigger return spring, which is the reason for insufficiently accurate shooting at the target.

SUMMARY OF THE INVENTION

The objective of the invention is to improve the accuracy of shooting by significantly reducing the force on a trigger during firing.

The above objective is achieved by a trigger mechanism for a firearm, which comprises a trigger, a hammer having a notch for receiving a roller, a sear connected to the trigger, and the roller mounted on the sear and configured to roll on an engagement surface of the notch made in the hammer. The trigger has a guide rod having a protrusion engaging with a plunger holding the trigger in a firing position. The trigger has a groove to allow its free movement when engaging with the plunger. The hammer and the trigger have cams engaging with each other and allowing the protrusion of the trigger to return to the firing position.

Additionally, the guide rod of the trigger mechanism has a hook which allows the protrusion of the trigger to return to the firing position by activating a safety lock.

With the trigger mechanism thus configured, it is possible to reduce the force on the trigger by disabling the impact of a spring of a trigger return mechanism when the roller sear and the trigger are in a closed static position, thereby providing more accurate shots.

Safety is ensured by moving the trigger toward a muzzle end and returning the same amount of force by simply activating the safety lock. After each cycle of operation of a breechblock or a breechblock carrier, the return mechanism on an automatic weapon is engaged in case it is disengaged.

BRIEF DESCRIPTION OF DRAWINGS

The invention is explained by the drawings, where.

DETAILED DESCRIPTION OF THE INVENTION

Figure 2:
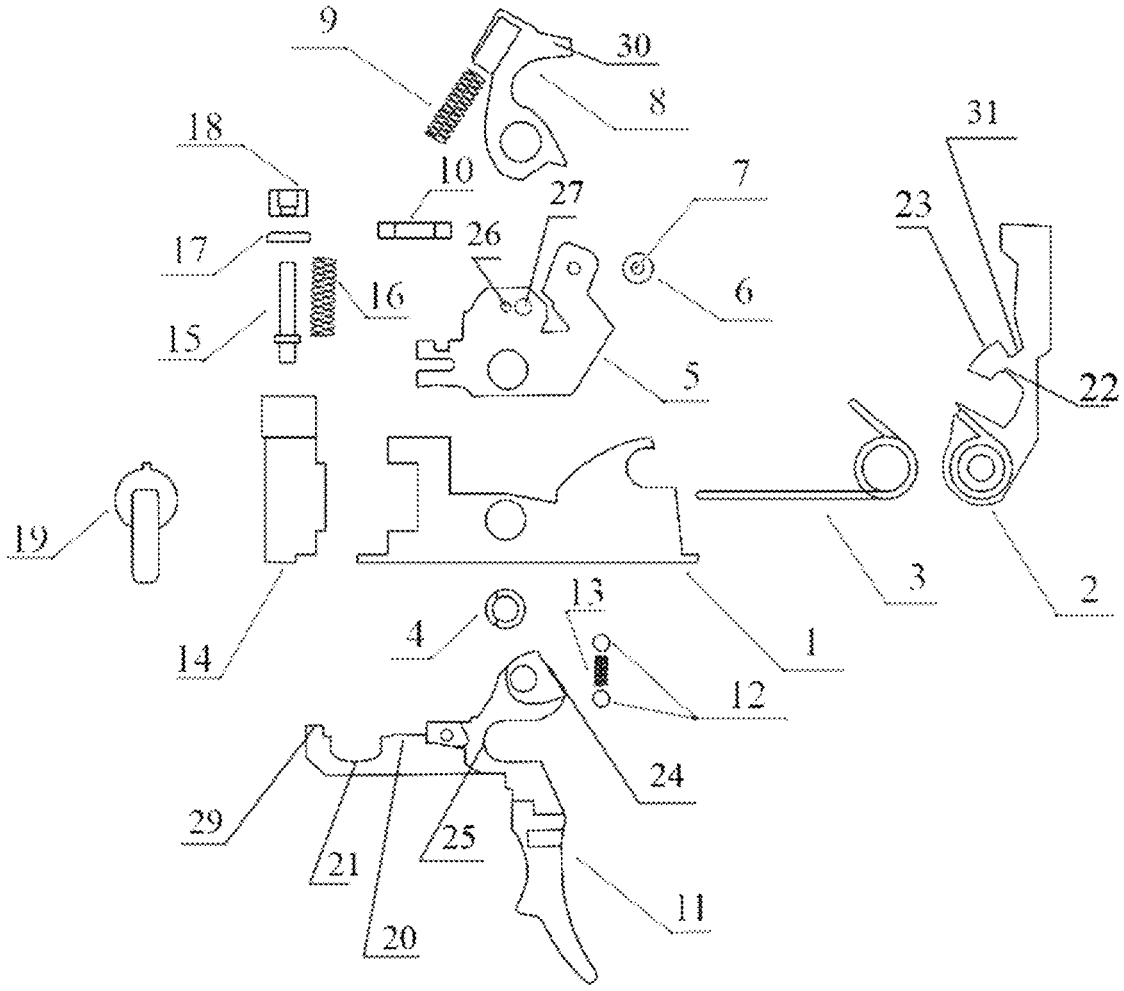
FIG. 2 shows a disassembled view of the trigger mechanism.
Figure 3:
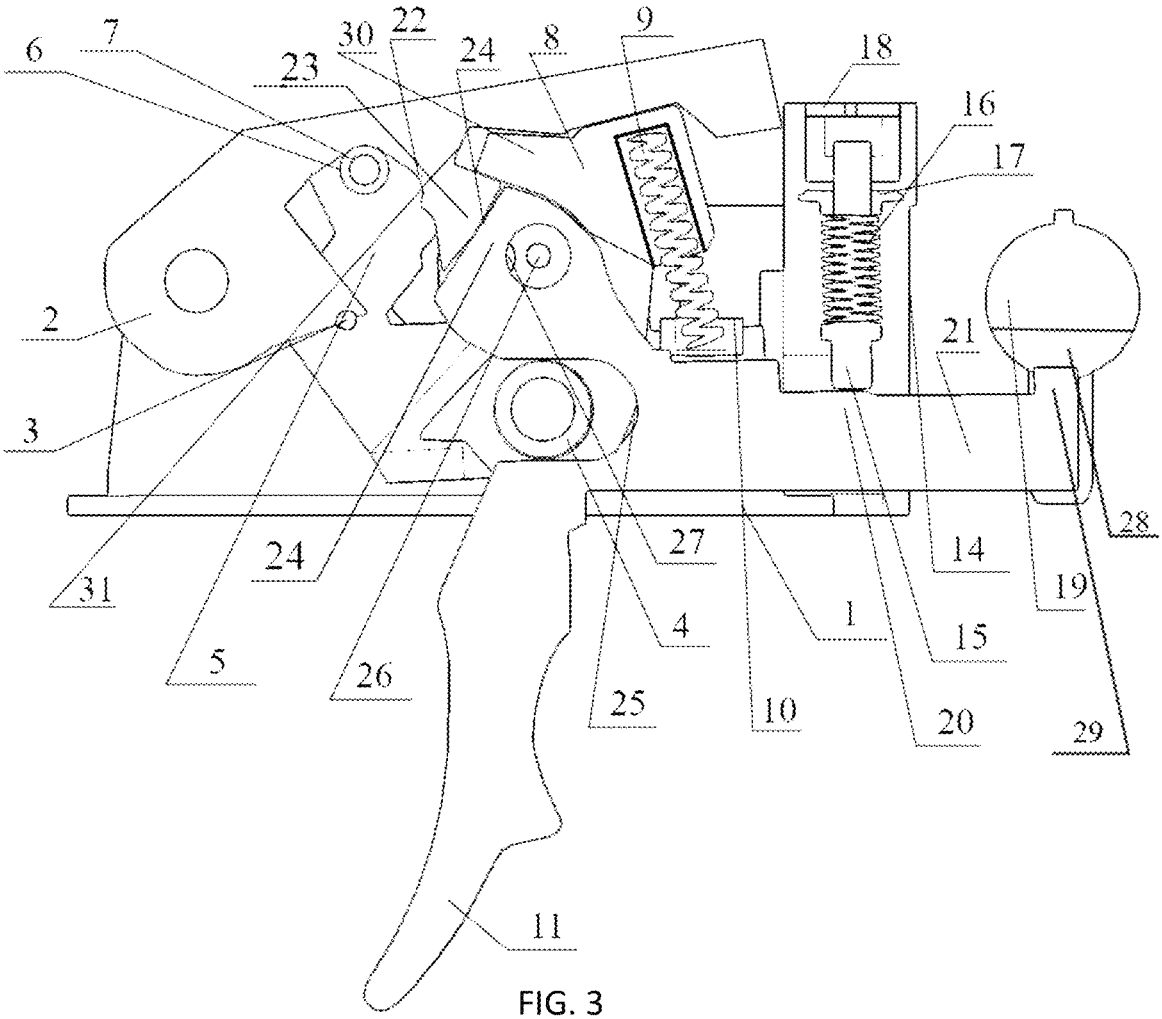
FIG. 3 shows a longitudinal section of the trigger mechanism, where a hammer in a lower position is engaged with a single-fire sear, a trigger is not moved, a return mechanism is engaged, and its spring is in a compressed state (position 1)

A trigger mechanism comprises (FIG. 2) a housing 1, a hammer 2 with a firing spring 3, a tubular axle 4, a roller sear 5, a roller 6, a roller axle 7, a single-fire sear 8, a single-fire sear spring 9, a single-fire spring support pad 10, a trigger 11, trigger retainer balls 12 in position 1 (FIGS. 3, 4, 6) and in position 2 (FIG. 5), a trigger retainer spring 13, a return mechanism housing 14, a return mechanism plunger 15 in position 1 (FIGS. 1, 3, 4, 6) and in position 2 (FIG. 5), a plunger spring 16, a lock washer 17, a nut 18, a safety-lock pin having a flag 19 (installed in the firearm housing) in position 1 (FIGS. 1, 2, 3, 4, 5), a trigger guide-rod protrusion 20 in position 1 (FIGS. 1, 3, 4, 6) and in position 2 (FIG. 5), a trigger guide rod 21, a hammer notch 22 in position 1 (FIGS. 4, 5, 6) and in position 2 (FIG. 3), a hammer cam 23 in position 1 (FIGS. 4, 5, 6) and in position 2 (FIG. 3), a trigger cam 24 in position 1 (FIGS. 3, 4, 6) and in position 2 (FIG. 5), a trigger groove 25 in position 1 (FIGS. 1, 3, 4, 6) and in position 2 (FIG. 5), retainer holes 26 and 27, a safety-lock pin notch 28 in position 1 (FIGS. 3, 4, 5) and in position 2 (FIG. 6), a trigger guide-rod hook 29 in position 1 (FIGS. 3, 4, 6) and in position 2 (FIG. 5), a single-fire sear hook 30 in position 1 (FIGS. 1, 4, 5, 6) and in position 2 (FIG. 3), and a single-fire sear hammer hook 31 in position 1 (FIGS. 4, 5, 6) and in position 2 (FIG. 3).

Operation of the Trigger Mechanism

Figure 1:
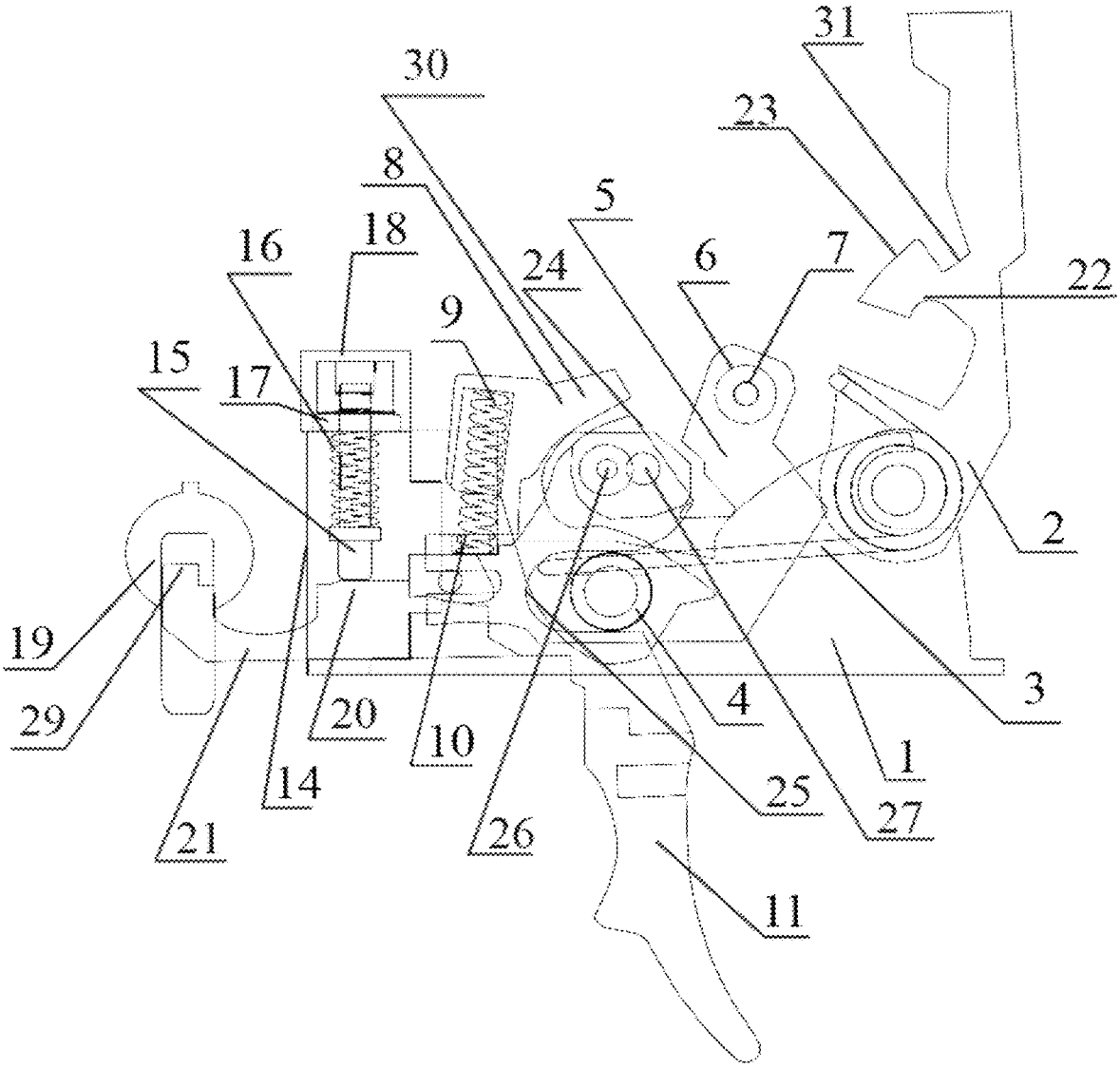
FIG. 1 shows a general view of a trigger mechanism.
Figure 4:
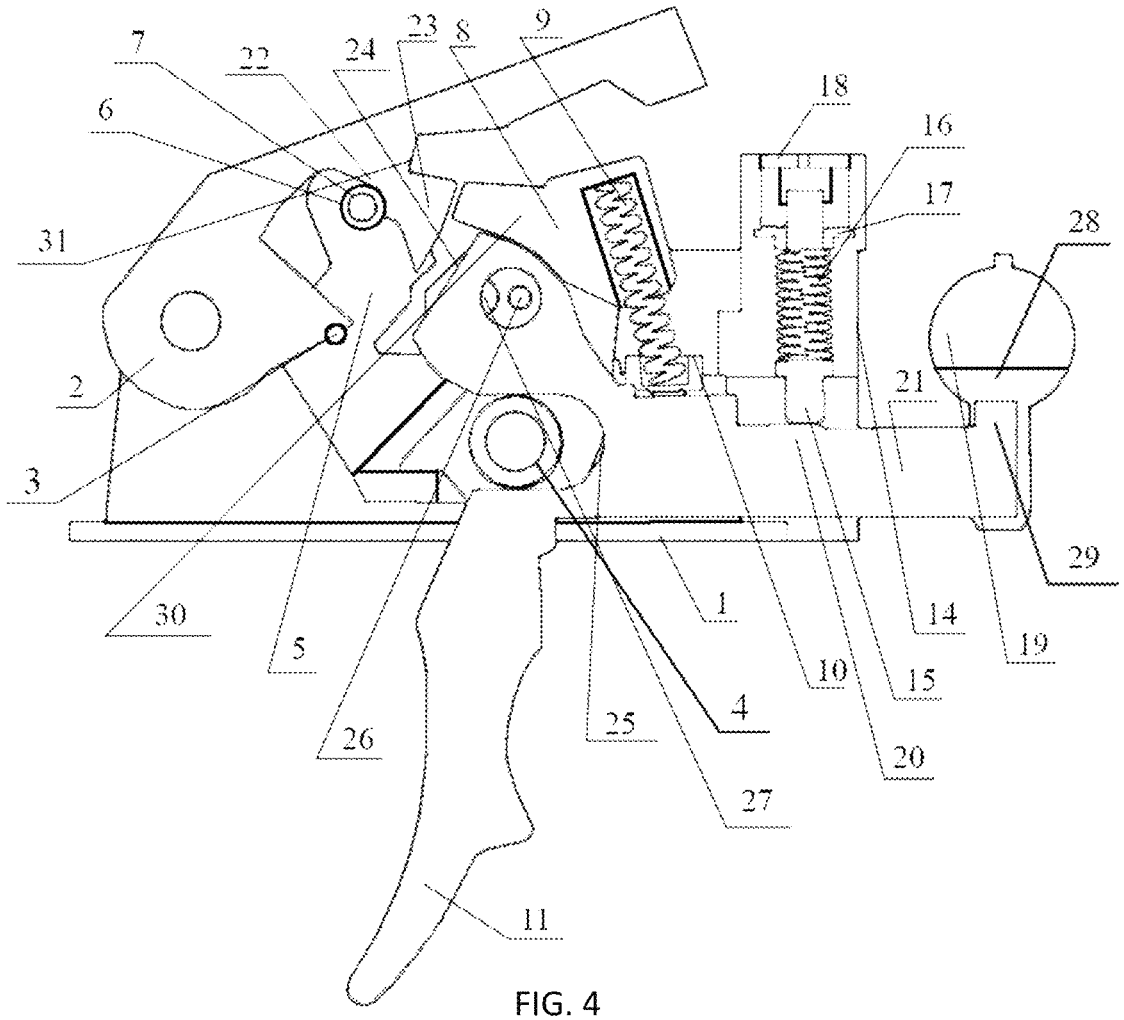
FIG. 4 shows a longitudinal section of the trigger mechanism, where the hammer in a firing position, the trigger is not moved, and the return mechanism is engaged (position 1)
Figure 5:
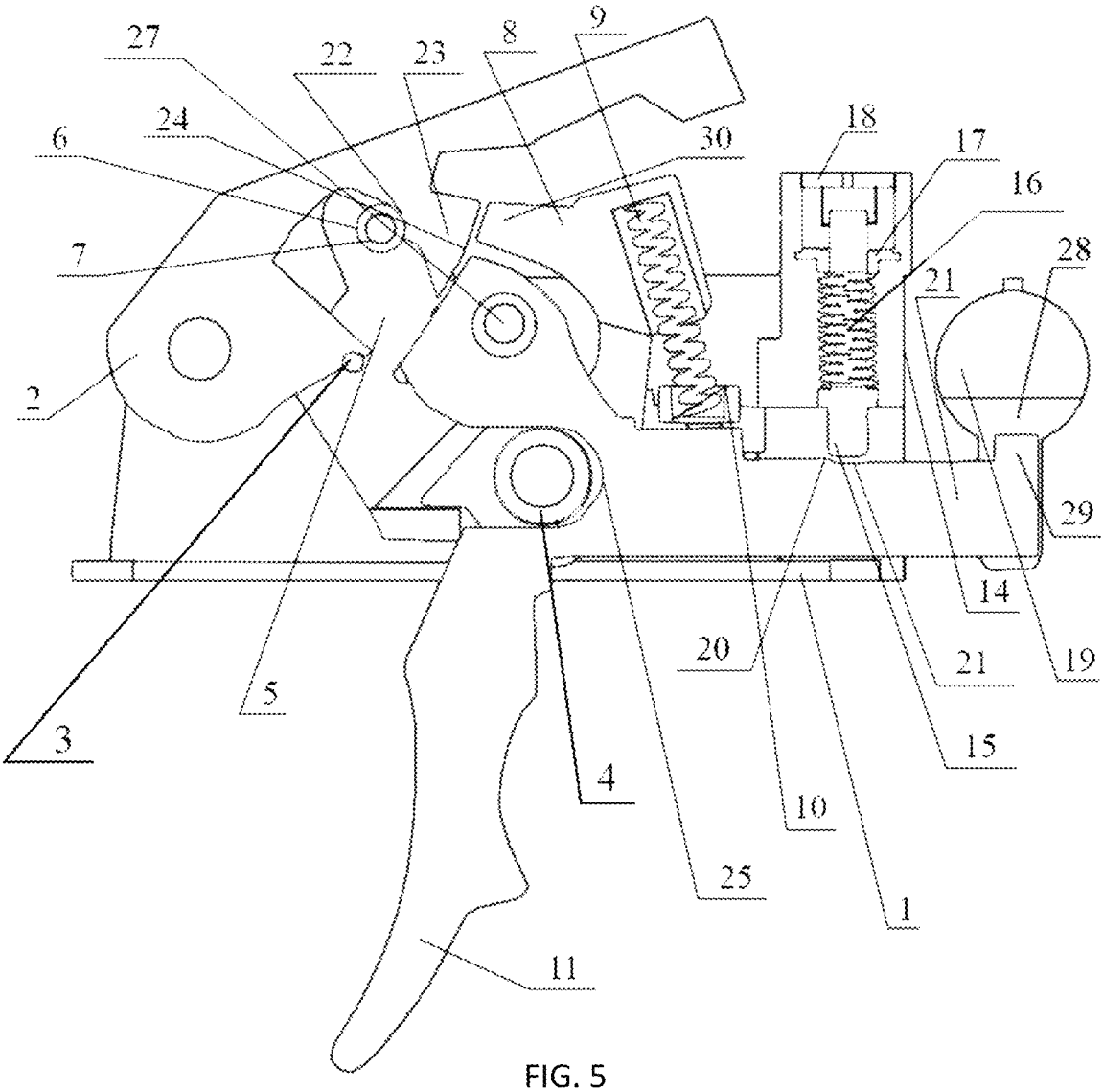
FIG. 5 shows a longitudinal section of the trigger mechanism, where the trigger is moved towards a muzzle end, the hammer is in the firing position, and the return mechanism is disengaged (position 2)
Figure 6:
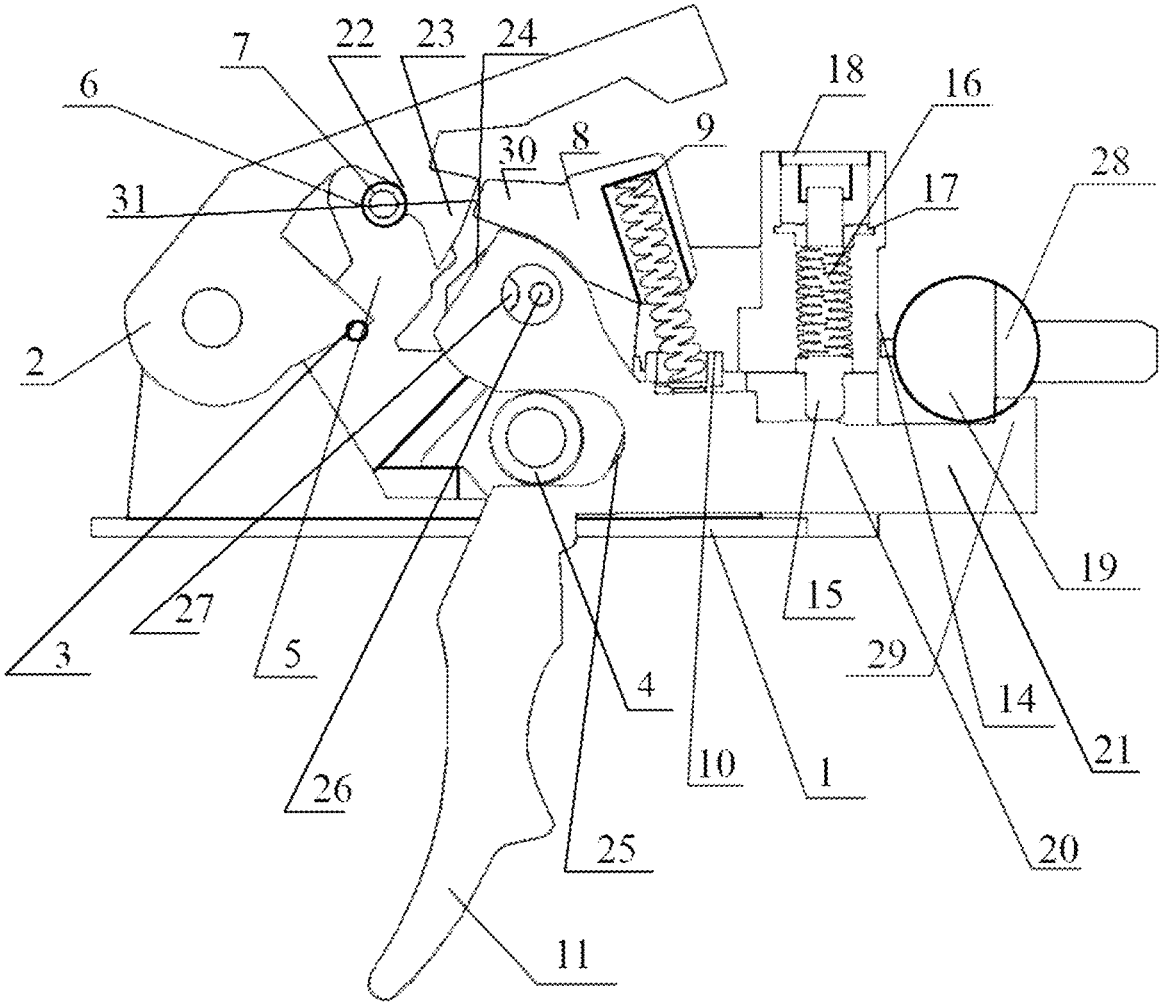
FIG. 6 shows a longitudinal section of the trigger mechanism, where the hammer is in the firing position, the trigger is not moved, the return mechanism is engaged, and a safety lock is engaged (position 1).

The trigger 2 is engaged with the roller 6 of the roller sear 5 (FIGS. 4, 5). When the trigger 11 is pressed, the roller sear 5 begins to rotate around the tubular axle 4, and at the same time the protrusion 20 of the guide rod 21 of the trigger 11 exerts pressure on the return mechanism plunger 15 (FIG. 4) and compresses its spring 16, whereby the spring and the plunger are held by the washer 17 and the nut 18 (FIG. 4). By rotating around the axle 7, the roller 6 rolls over the hammer notch 22 and allows the hammer 2 under the influence of the firing spring 3 to disengage and strike an ammunition primer (FIG. 1). After the ammunition is fired, the hammer 2 returns under the action of a breechblock carrier. Geometrically, the trigger notch 22 is designed so as to rotate the roller sear 5 to the angle of reliable engagement of the automatic-fire sear 8 with the hammer 2 by the hooks 30 and 31 (FIG. 3). After the breechblock carrier returns to a front position, the plunger 15 (FIG. 4) under the influence of the spring 16 presses on the protrusion 20 (FIG. 4) of the guide rod 21 of the trigger 11 and the sear roller 6 smoothly rolls down to the position of engagement and locking in the notch 22 (FIGS. 4, 5) made in the hammer 2, and the single-fire sear hooks 30 and 31 of the hammer 2 are disengaged (FIGS. 4, 5). When the trigger 11 (FIG. 5) is moved towards the muzzle end, the retainer balls 12 being under the pressure of the spring 13 move from the holes 26 into the holes 27 of the retainer of the trigger 11, the groove 25 of the trigger 11 moves from the position of FIG. 4 to the position of FIG. 5 with respect to the tubular axle 4, and the protrusion 20 (FIG. 4) moves and comes out from under the plunger 15 (FIG. 5) so that a gap is formed between it and the guide rod 21, i.e., the effect of the spring 16 is disconnected and the force on the trigger 11 drops sharply (FIG. 5). When the breechblock carrier rolls back to a rear position, the cam 23 (FIG. 3) of the hammer 2 acts, with its surface moving downward, on the cam 24 of the trigger 11 and moves it from position 2 of FIG. 5 to position 1 shown in FIGS. 3, 4, 6, i.e., the return mechanism is engaged after each cycle of operation of the breechblock or breechblock carrier. The trigger 11 from position 2 of FIG. 5 can be brought to position 1 of FIGS. 3, 4, 6 by activating the safety lock (FIG. 6), and the notch 27 of the safety-lock pin 19 will move the trigger backwards, acting by its rotation on the hook 29 of the guide rod 21, i.e., the return mechanism will be engaged.

INDUSTRIAL APPLICABILITY

In accordance with the invention, a prototype of the trigger mechanism for a firearm has been created. The prototype is fully operational. At the present time, about 1500 shots have been fired, no misfires or delays have been recorded. A safety test has been conducted. The hammer is firmly held on the cocking when the return mechanism is disabled when hitting the external parts of the firearm, excluding the trigger, with a rubber hammer weighing 280 g. When the firearm falls on a hard shock-absorbing obstacle (a rubber mat on a concrete floor) from a height of 1.5 meters, there is an inertial activation of the return mechanism of the trigger.

The invention claimed is:

1. A trigger mechanism for a firearm, comprising:

a trigger;

a hammer having a notch for receiving a roller;

a sear connected to the trigger; and the roller mounted on the sear and configured to roll on an engagement surface of the notch made in the hammer;

wherein the trigger has a guide rod having a protrusion engaging with a plunger holding the trigger in a firing position;

wherein the trigger has a groove through which the trigger is configured to freely move when engaging with the plunger; and wherein the hammer and the trigger have cams engaging with each other and configured to return the protrusion of the trigger to the firing position.

2. The trigger mechanism of claim 1, wherein the guide rod has a hook configured to return the protrusion of the trigger to the firing position when a safety lock of the firearm is activated.

* * * * *